US006873220B2

(12) United States Patent
Jan et al.

(10) Patent No.: US 6,873,220 B2
(45) Date of Patent: Mar. 29, 2005

(54) METHOD AND APPARATUS FOR RECEIVING LINEAR POLARIZATION SIGNAL AND CIRCULAR POLARIZATION SIGNAL

(75) Inventors: Cheng-Geng Jan, Taipei (TW); Chung-Min Lai, Taipei (TW)

(73) Assignee: Wistron Neweb Corporation (TW)

( * ) Notice: Subject to any disclaimer, the term of this patent is extended or adjusted under 35 U.S.C. 154(b) by 278 days.

(21) Appl. No.: 10/278,674

(22) Filed: Oct. 22, 2002

(65) Prior Publication Data

US 2003/0169126 A1 Sep. 11, 2003

(30) Foreign Application Priority Data

Mar. 7, 2002 (TW) ..... 91104245 A

(51) Int. Cl.[7] ..... H01P 5/12

(52) U.S. Cl. ..... 333/21 A; 333/21 R; 333/126; 333/137

(58) Field of Search ..... 333/21 A, 125, 333/137, 126, 21 R

(56) References Cited

U.S. PATENT DOCUMENTS 3,978,434 A * 8/1976 Morz et al. ..... 333/135
4,030,048 A * 6/1977 Foldes ..... 333/135
4,228,410 A * 10/1980 Goudey et al. ..... 333/122
4,797,681 A * 1/1989 Kaplan et al. ..... 343/786
4,847,574 A * 7/1989 Gauthier et al. ..... 333/21 A
5,038,150 A * 8/1991 Bains ..... 342/373
5,345,591 A * 9/1994 Tsurumaki et al. ..... 725/69
5,568,158 A * 10/1996 Gould ..... 343/756
6,046,655 A * 4/2000 Cipolla ..... 333/137
6,507,323 B1 * 1/2003 West ..... 343/772
6,661,309 B2 * 12/2003 Chen et al. ..... 333/126
6,724,277 B2 * 4/2004 Holden et al. ..... 333/125

* cited by examiner

*Primary Examiner*—Benny Lee
*Assistant Examiner*—Kimberly Glenn
(74) *Attorney, Agent, or Firm*—Baker Botts L.L.P.

(57) ABSTRACT

The present invention discloses a method and apparatus for simultaneously receiving linear polarization signals and circular polarization signals. First, the present invention gathers a plurality of signals and separates them into a first linear polarization signal and a circular polarization signal in a predetermined way. The present invention transforms the circular polarization signal into a second linear polarization signal. The first linear polarization signal and the second linear polarization signal are transferred to an electric circuit.

20 Claims, 9 Drawing Sheets

METHOD AND APPARATUS FOR RECEIVING LINEAR POLARIZATION SIGNAL AND CIRCULAR POLARIZATION SIGNAL

CROSS REFERENCE TO RELATED APPLICATION

This application claims priority of Taiwan Patent Application Serial No.091104245 filed on Mar. 7, 2002.

FIELD OF INVENTION

The present invention relates to a method and apparatus for simultaneously receiving signals, and more particularly, to a method and apparatus for simultaneously receiving linear polarization signals and circular polarization signals.

BACKGROUND OF THE INVENTION

Satellite signal transmission techniques improve substantially to meet people's needs in many ways, such as communication, astronomical observation, meteorological observation, and so forth. As a result, the number of the operating satellites in space grows rapidly as the need for satellites increases in recent years. Sometimes, the space is so crowded that two satellites may even be set in almost the same orbit.

As to current techniques of satellite signal transmission, the Fixed-Satellite Service (FSS) is used to receive linear polarization signals with frequencies about 10.95 GHz to 11.7 GHz. The Broadcasting-Satellite Service (BSS) is used to receive circular polarization signals with frequencies about 12.2 GHz to 12.7 GHz. Those two types of satellite services have close frequency bands and usually are set in almost the same orbit. Thus, the corresponding receivers or feeds for receiving satellite signals must have the ability to receive linear polarization signals from FSS satellites and to receive circular polarization signals from BSS satellites. However, it is quite difficult to receive two types of signals by one single receiver or feed with current techniques. Also, the issue for avoiding interference between two types of signals needs to be solved for the time being. Therefore, receivers or feeds of the prior art are not able to take up the challenge. Instead, most traditional receivers or feeds could only receive one type of signals. For example, it takes two different feeds to receive linear polarization signals and circular polarization signals respectively.

As shown in FIG. 1, in the prior art, two antenna disks 11 and 12 are used to receive a linear polarization signal 111 and a circular polarization signal 121 respectively. This kind of method of implementing two antenna disks is quite uneconomical.

The U.S. Pat. No. 3,731,236 discloses an apparatus for transferring and receiving two types of signals. As shown in FIG. 2, the apparatus includes a transformer 14 connecting to a four-port ortho-mode transducer (OMT) 13. The four-port ortho-mode transducer (OMT) 13 connects to four rectangular waveguides 21, 22, 23, and 24 respectively. While receiving signals, low frequency signals are transferred through the four rectangular waveguides 21, 22, 23, and 24. However, when the transferred low frequency signals, including circular polarization signals, passing through the four rectangular waveguides 21, 22, 23, and 24, the circular polarization signals will be distorted or destroyed. That is to say, instead of receiving signals of any frequencies, the apparatus could only operates normally when the frequency of the linear polarization signals is lower than that of the circular polarization signals.

Consequently, with current techniques for satellite signal transmission, a novel apparatus and method for receiving all types of signals with any frequencies, without serious interference, is desired.

SUMMARY OF THE INVENTION

The objective of the present invention is to provide a method and apparatus for simultaneously receiving linear polarization signals and circular polarization signals.

In the present invention, the linear polarization signals and the circular polarization signals received in the same orbit are separated first and then integrated to at least a low noise block (LNB).

In the method of the present invention, signals including the linear polarization signal and the circular polarization signal are received in a predetermined way and separated into a first linear polarization signal and a circular polarization signal. The circular polarization signal is then transformed into a second linear polarization signal. The first linear polarization signal and the second linear polarization signal are then transferred to an electric circuit.

The apparatus of the present invention includes a receiver, an ortho-mode transducer (OMT), a polarizer, and an electric circuit. The receiver is used to receive signals. The ortho-mode transducer (OMT) is used to separate the received signals into a first linear polarization signal and a circular polarization signal. The polarizer is used to transform the circular polarization signal into a second linear polarization signal.

Additional objects and advantages of the invention will be set forth in the description which follows, and in part will be obvious from the description, or may be learned by practicing the invention.

DETAILED DESCRIPTION

In order to achieve the objective of simultaneously receiving linear polarization signals and circular polarization signals, the present invention separates linear polarization signals and circular polarization signals first, and then integrates them to at least a low noise block (LNB).

Figure 1:
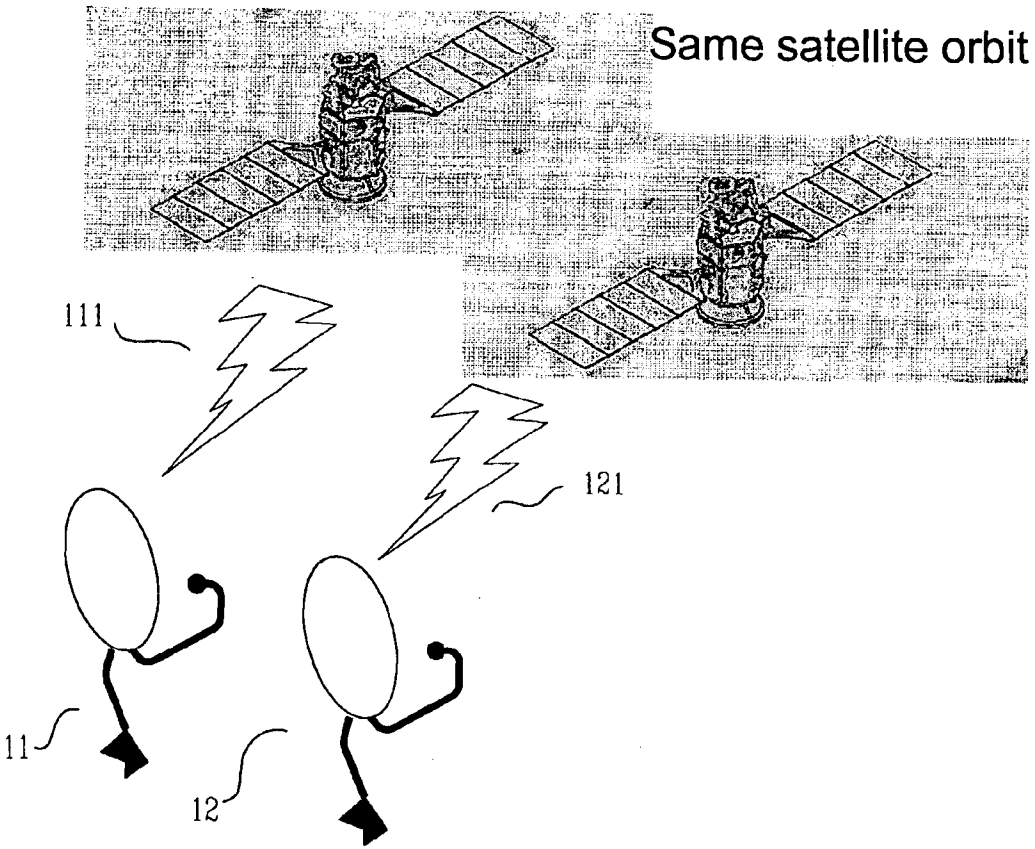
Fig.1(prior art)
FIG. 1 is a schematic diagram of an apparatus for receiving signals with two antenna disks according to the prior art.
Figure 2:
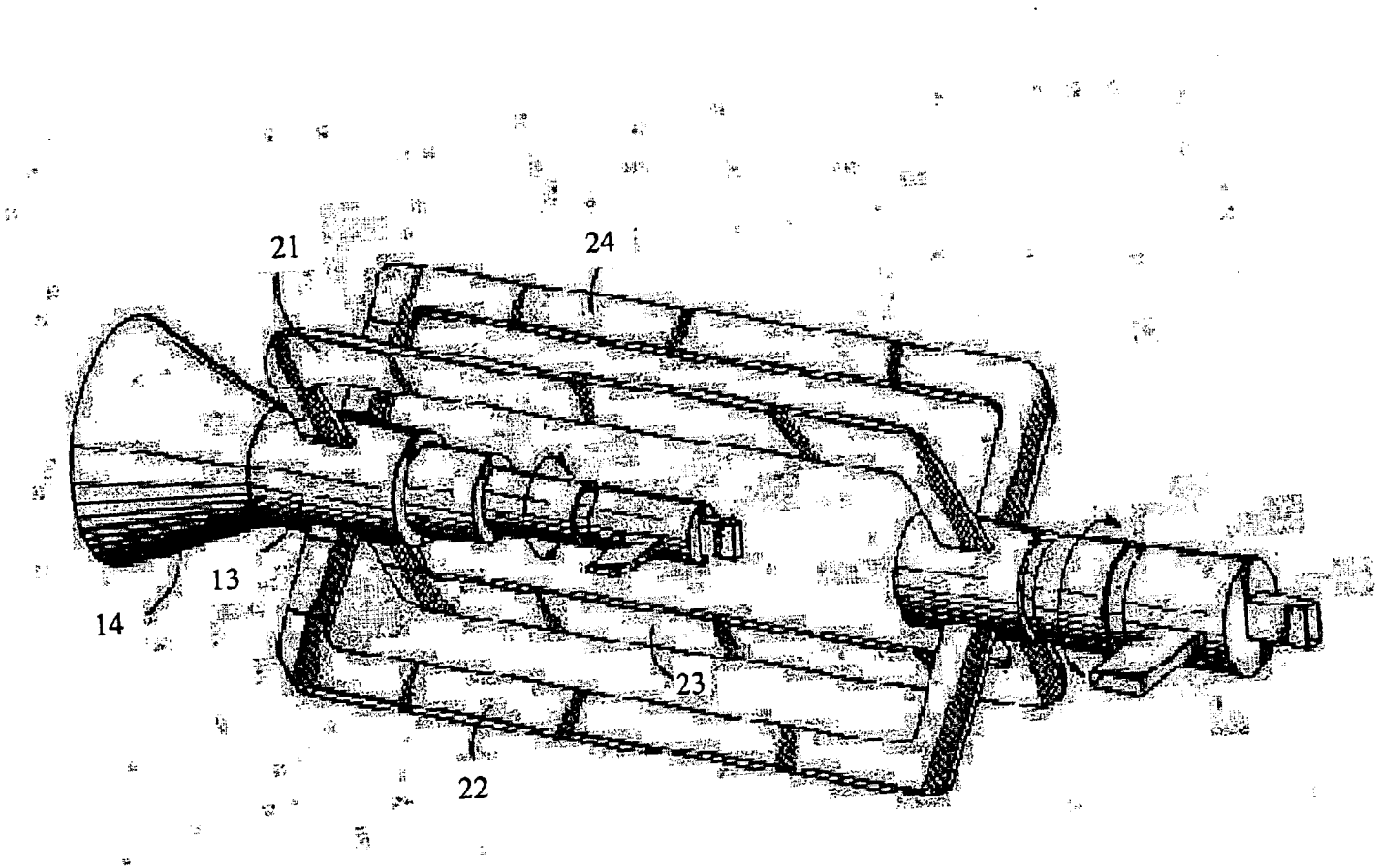
Fig.2(prior art)
FIG. 2 is a schematic diagram of an apparatus for receiving signals according to the prior art.
Figure 3:
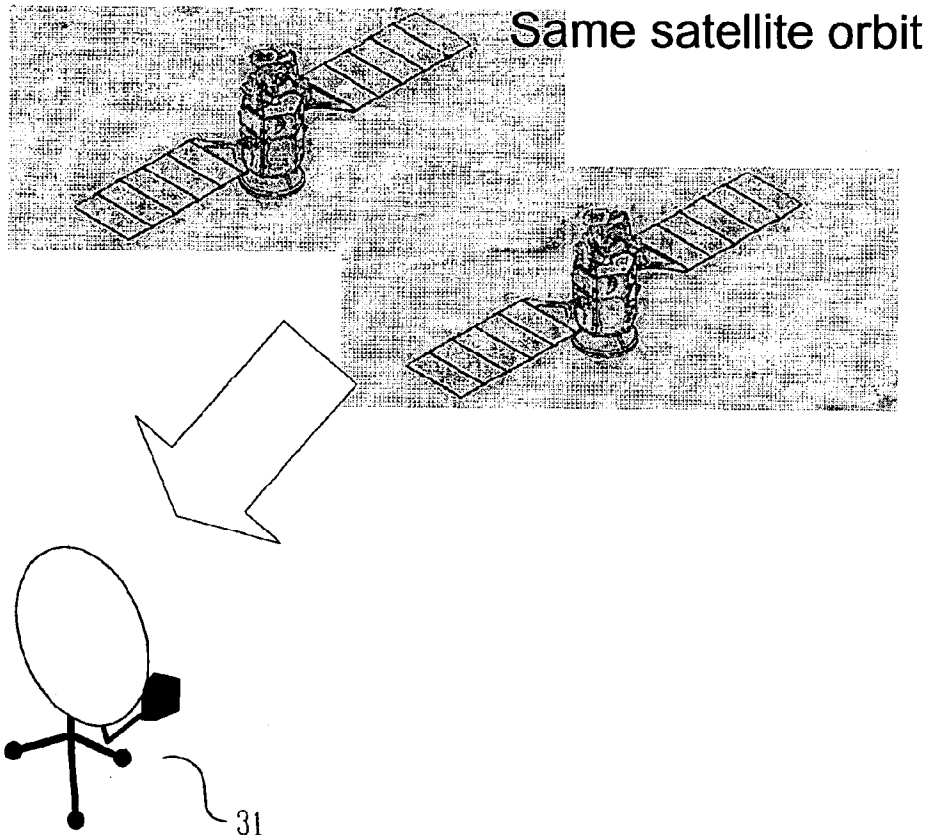
FIG. 3 is a schematic diagram of an apparatus for receiving signals with one antenna disk according to the present invention.

As shown in FIG. 3, the apparatus for receiving signals of the present invention only needs one antenna disk 31. In comparison with the prior art, the present invention substantially reduces the required space and cost for building more antenna disks for receiving all types of signals.

Figure 4:
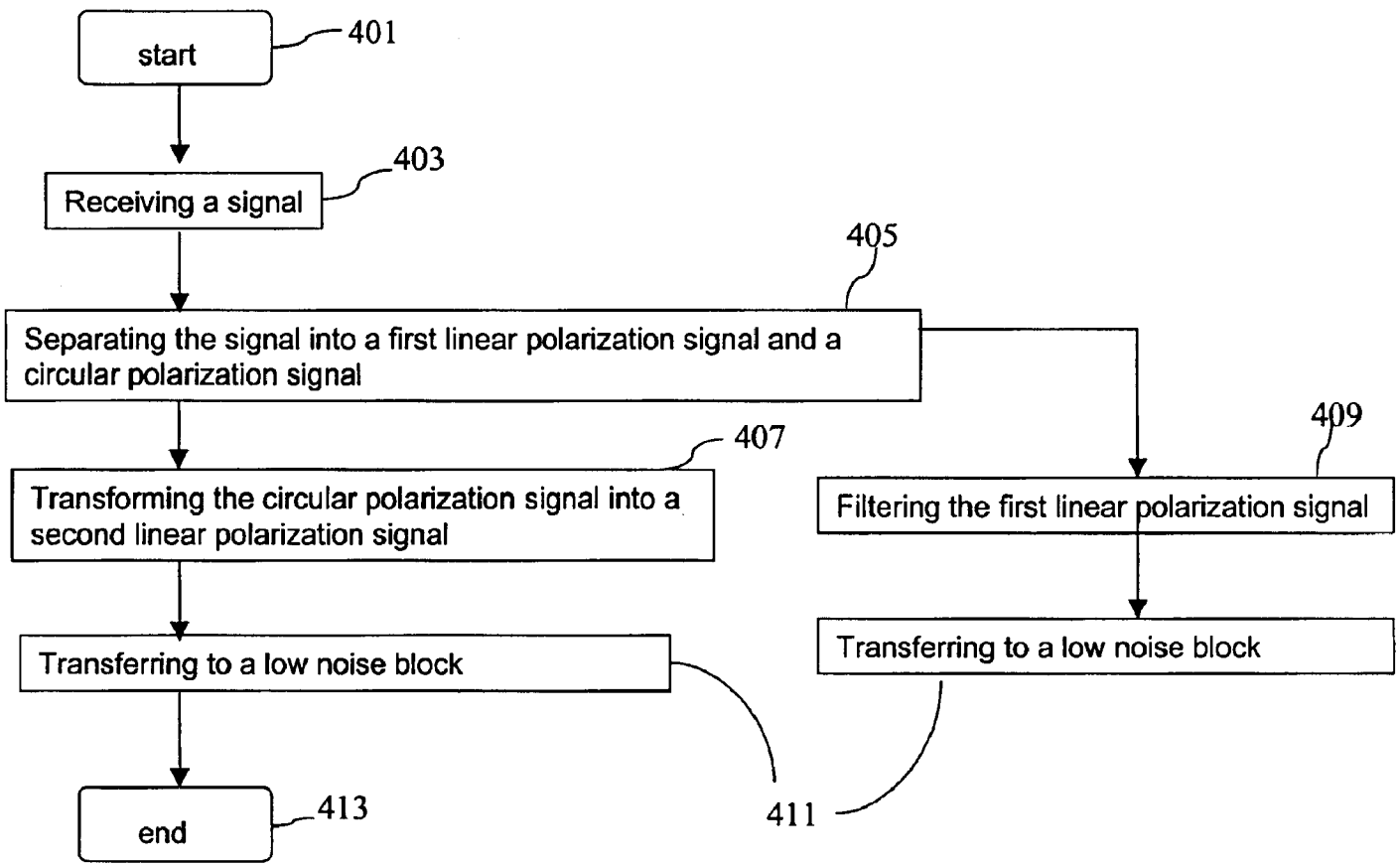
FIG. 4 is a schematic flowchart of a first exemplary embodiment of the method for receiving signals according to the present invention.

FIG. 4 is a schematic flowchart of a first exemplary embodiment of the method for receiving a signal according to the present invention. In the first embodiment, the method for receiving a signal includes the step 401 to the step 413.

First, in the step 403, a signal received from a receiver is transferred to a waveguide.

Next, in the step 405, the signal is separated into a first linear polarization signal and a circular polarization signal by respectively transferring them to a first waveguide and a second waveguide. The first waveguide and the second waveguide respectively have different cutoff frequencies. The first linear polarization signal selectively includes a first signal in a first direction and a second signal in a second direction. In the embodiment, the first direction and the second direction are orthogonal to each other. For example, if the first direction is horizontal, the second direction will be vertical.

Additionally, the cross-section dimensions of the waveguides, the first waveguide and the second waveguide, are different and could be adjusted to vary the value of their cutoff frequencies. In the embodiment, the first linear polarization signal and the circular polarization signal are separated by adjusting the cross-section dimensions of the waveguides.

Besides, the phrase "selective include" mentioned above and below means to include any one, all of them, or combination of some of them.

Then, in the step 407, the circular polarization signal is transformed into a second linear polarization signal. The second linear polarization signal selectively includes a third signal in the first direction and a fourth signal in the second direction. In particular, the circular polarization signal selectively includes a left-hand circular polarization (LHCP) and a right-hand circular polarization (RHCP). In the step 407, the left-hand circular polarization (LHCP) and the right-hand circular polarization (RHCP) are transformed into the third signal and the fourth signal respectively.

Assume that the frequency of the first linear polarization signal is lower than that of the circular polarization signal. In the step 409, the first linear polarization signal in the first waveguide is filtered by a low pass filter to filter out an undesired high frequency noise. Thus, the first signal and the second signal with lower frequencies are preserved. On the other hand, if the frequency of the circular polarization signal is lower than that of the first linear polarization signal, in the step 409, the circular polarization signal in the second waveguide will be filtered by a low pass filter to filter out an undesired high frequency noise. Accordingly, the present invention is not restricted to any limitation to the frequencies of the linear polarization signal and the circular polarization signal.

To simplify the description, in the following description, we assume that the frequency of the linear polarization signal is lower than that of the circular polarization signal.

Next, proceed to the step 411. In the step 411, after filtering, the first signal and the second signal of the first linear polarization signal and the third signal and the fourth signal of the second linear polarization signal are transferred respectively to two low noise blocks (LNB). Thus, the signal with the linear polarization signal and the circular polarization signal are completely received and become a new signal with only one polarization-type.

Figure 5:
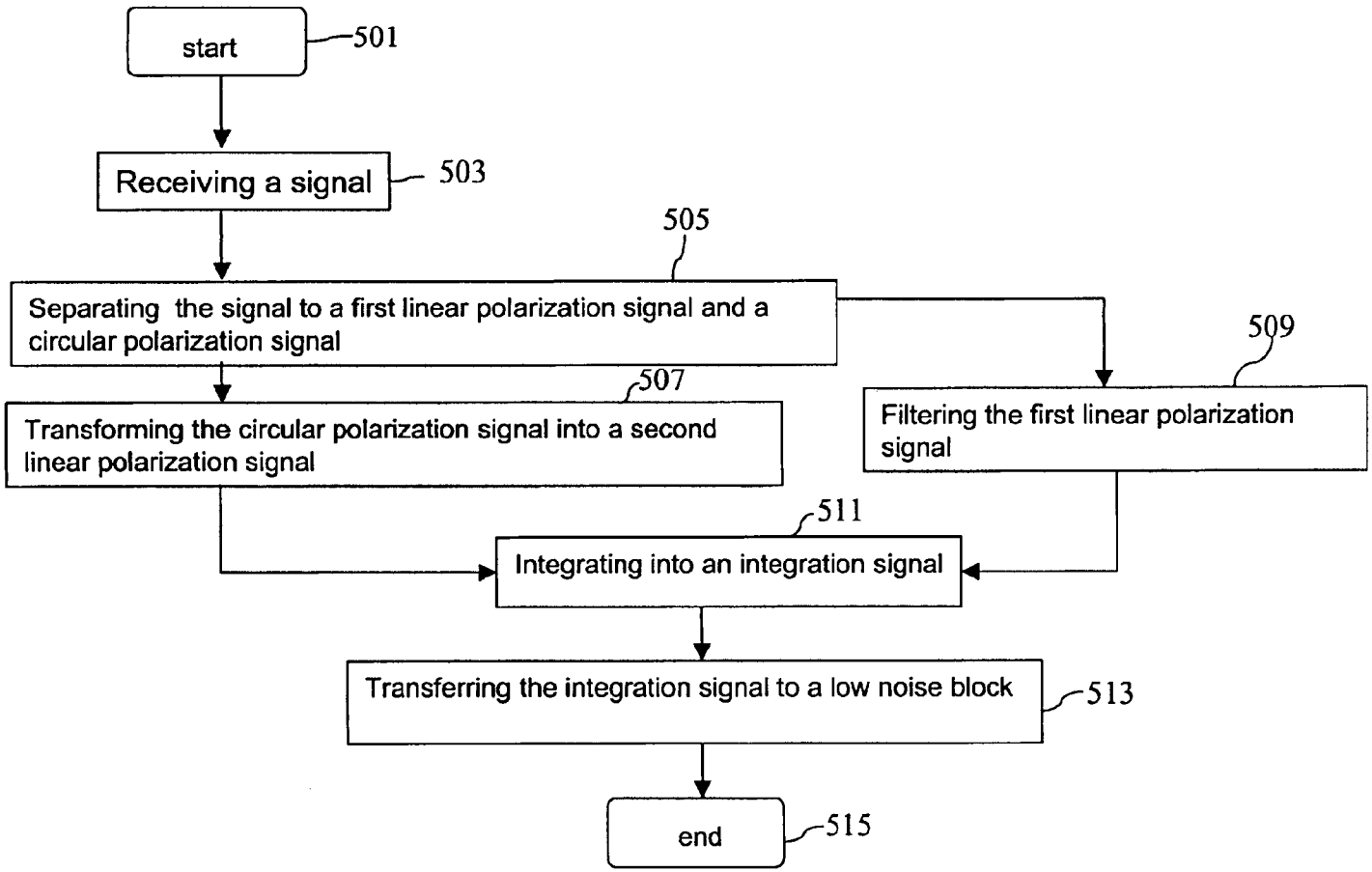
FIG. 5 is a schematic flowchart of a second exemplary embodiment of the method for receiving signals according to the present invention

FIG. 5 is a schematic flowchart of a second exemplary embodiment of the method for receiving a signal according to the present invention. In the embodiment, the method for receiving a signal includes the step 501 to the step 515.

The steps, from the step 501 to the step 509, are respectively identical to the step 401 to the step 409. After the step 509, the first linear circular polarization signal with lower frequency is separated from the circular polarization signal. For the time being, the first linear polarization signal has a first signal and a second signal, which are low pass filtered. The circular polarization has a third signal and a fourth signal respectively transformed from the left-hand circular polarization (LHCP) and the right-hand circular polarization (RHCP).

The difference between the above two embodiments is in the step 511. In the step 511, the first signal, the second signal of the first linear polarization signal, and the third signal, the fourth signal of the second linear polarization signal are integrated to become an integration signal. The integration signal is then transferred to a waveguide. It could be understood that the integration signal in the step 511 is a reverse operation of the step 505.

After the step 511, the integration signal is transferred to a low noise block (LNB). Thus, the signal with the linear polarization signal and the circular polarization signal is completely received and becomes a new signal with only one polarization-type.

In the second embodiment, the present invention reduces the required space and cost not only for building more antenna disks for receiving all types of signals, but also for a set of low noise block (LNB). Thus, the present invention becomes much simpler and inexpensive.

Figure 6:
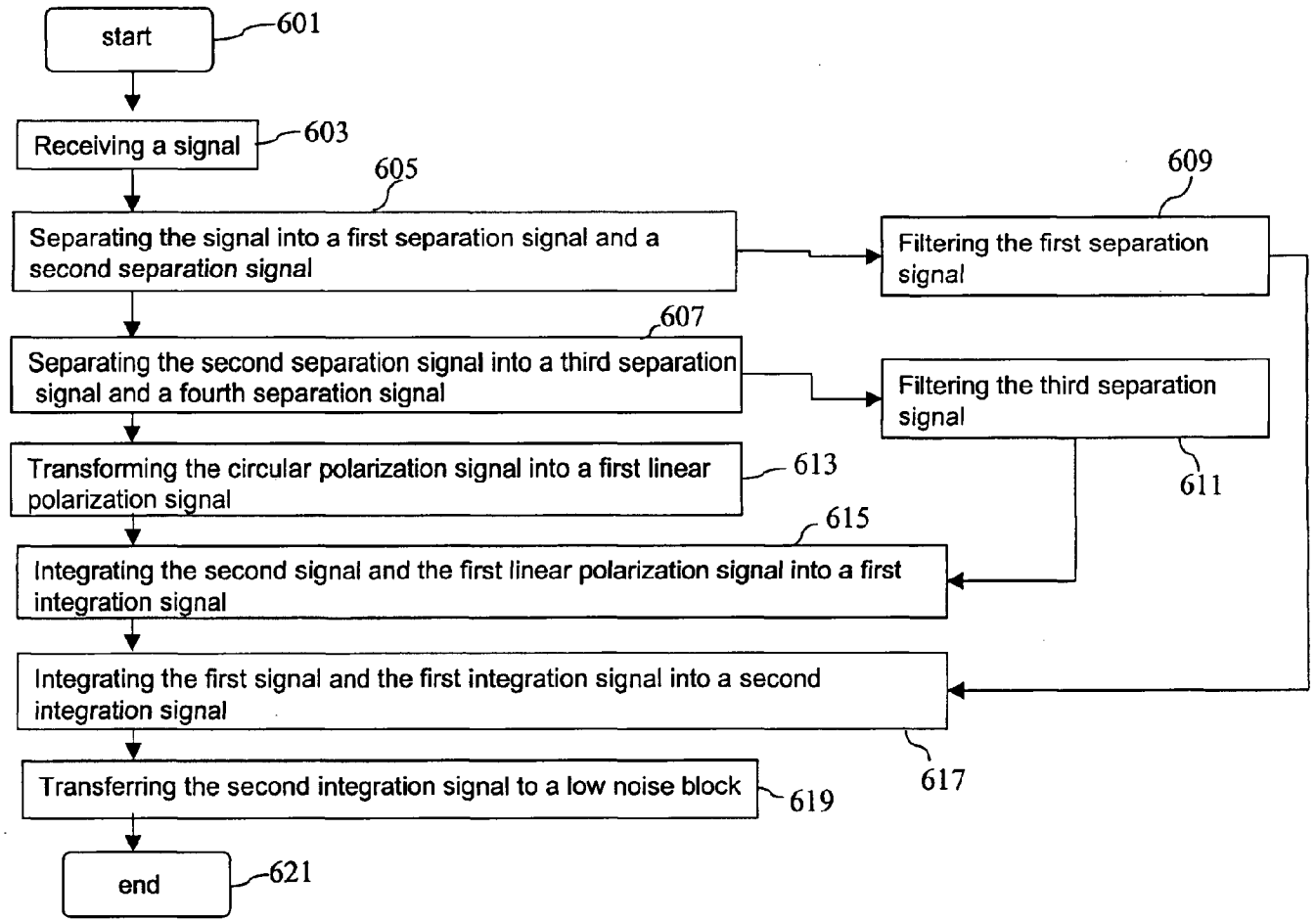
FIG. 6 is a schematic flowchart of a third exemplary embodiment of the method for receiving signals according to the present invention.

FIG. 6 is a schematic flowchart of a third exemplary embodiment of the method for receiving a signal according to the present invention. In the embodiment, the first signal and the second signal of the first linear polarization signal are respectively separated. The method of the present invention includes the step 601 to the step 621.

First, in the step 603, a signal received from a receiver is transferred to a main waveguide. Next, in the step 605, the signal is separated into a first separation signal and a second separation signal via the main waveguide, which is the waveguide for transferring majority of the circular polarization signals. The first separation signal, selectively including a first signal in a first direction, is transferred to a first waveguide.

Next, in the step 607, the second separation signal is separated into a third separation signal and a fourth separation signal via the main waveguide. The third separation signal, selectively including a second signal in a second direction, is transferred to a second waveguide. The fourth separation signal includes the circular polarization signal. In the embodiment, the first signal and the second signal are both linear polarization signals. The first direction and the second direction are orthogonal to each other.

In the step 609, the first separation signal in the first waveguide is filtered by a low pass filter. Thus, the undesired high frequency noise is filtered out from the first separation signal. The first signal with low frequency is preserved. Similarly, in the step 611, the third separation signal in the second waveguide is also filtered by another low pass filter.

Thus, the undesired high frequency noise is filtered out from the third separation signal. The second signal with low frequency is preserved.

In the step 613, the circular polarization signal in the main waveguide is transformed into a first linear polarization signal. The first linear polarization signal includes a third signal in the first direction and a fourth signal in the second direction. The circular polarization signal includes a left-hand circular polarization (LHCP) and a right-hand circular polarization (RHCP), which are transformed into a third signal and a fourth signal respectively.

In the step 615, the second signal, the third signal, and the fourth signal are integrated to become a first integration signal, which is transferred to the main waveguide.

Next, in the step 617, the first signal and the first integration signal are integrated to become a second integration signal, which is also transferred to the main waveguide.

In the step 619, the second integration signal in the main waveguide is transferred to a low noise block (LNB). Thus, the signal with the linear polarization signal and the circular polarization signal is completely received and becomes a new signal with only one polarization-type.

In the embodiment, the present invention reduces the required space and cost not only for building more antenna disks for receiving all types of signals, but also for a set of low noise block (LNB). Thus, the present invention becomes much simpler and inexpensive. Furthermore, since the present invention separates the first signal and the second signal before filtering them, a high performance filter, with optimum performance costing much more, is not necessary.

The above description shows the method for receiving a signal according to the present invention. Further description for an exemplary apparatus in accordance with the above method is showed below.

Figure 7:
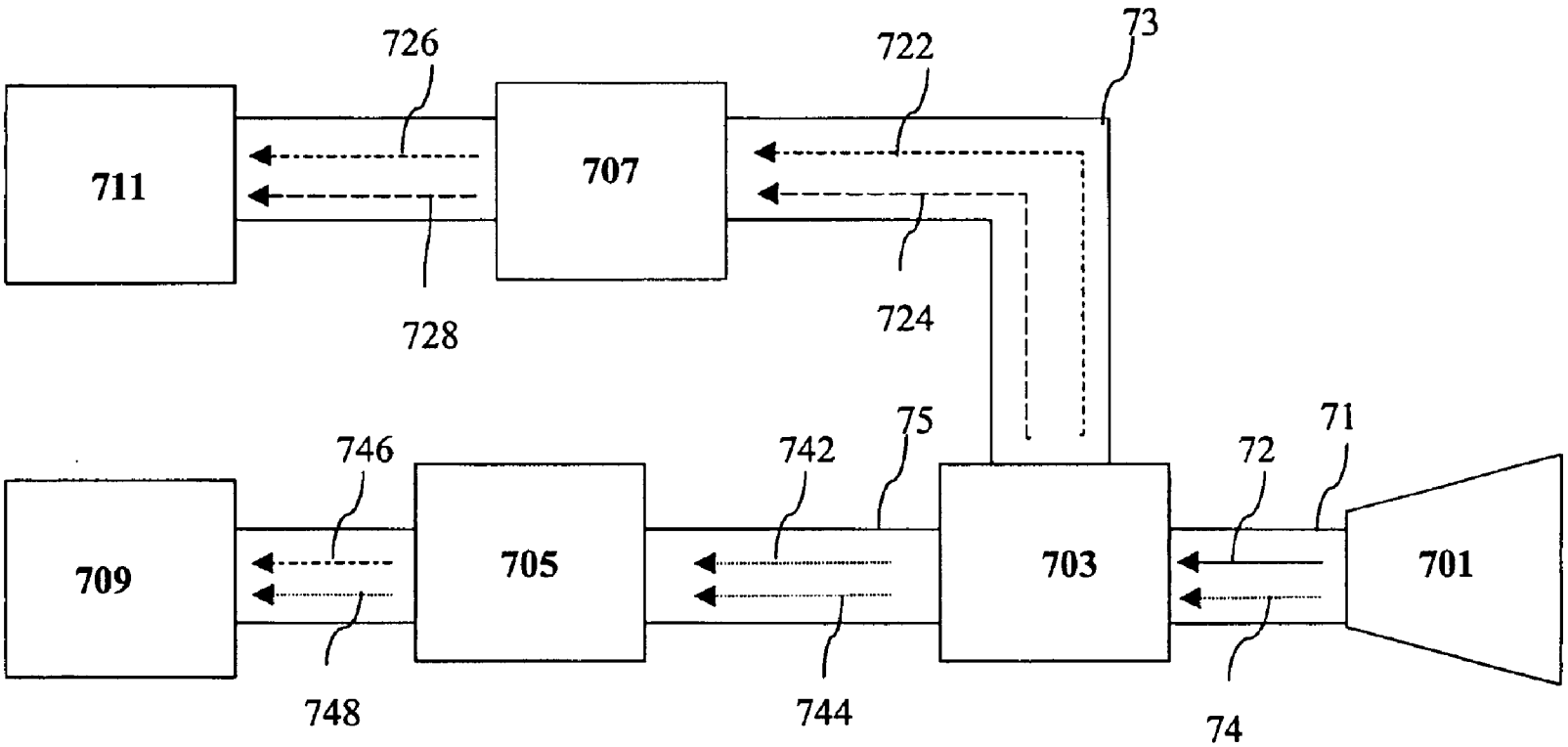
FIG. 7 is a schematic diagram of a first exemplary embodiment of an apparatus for receiving signals according to the present invention.

As shown in FIG. 7, the present invention provides an apparatus for simultaneously receiving linear polarization signals and circular polarization signals. The apparatus includes a receiver 701, an ortho-mode transducer (OMT) 703, a polarizer 705, a filter 707, and two low noise blocks 709 and 711.

The receiver 701 receives a signal and transfers it to a waveguide 71. The ortho-mode transducer (OMT) 703 separates the signal into a first linear polarization signal 72 and a circular polarization signal 74. The first linear polarization signal 72 and the circular polarization signal 74 are transferred to a first waveguide 73 and a second waveguide 75 respectively. The first linear polarization signal 72 selectively includes a first signal 722 in a first direction and a second signal 724 in a second direction. The first direction and the second direction are orthogonal to each other.

On the other hand, by adjusting the cross-section dimensions of the waveguides 73 and 75, signals with different cutoff frequencies may be separated. In the embodiment, the first linear polarization signal 72 and the circular polarization signal 74 are separated by respectively adjusting the cross-section dimensions of the waveguides 73 and 75.

After the separation of the signals 72 and 74, the polarizer 705 transforms the circular polarization signal 74 in the second waveguide 75 into a second linear polarization signal. The second linear polarization signal selectively includes a third signal 746 in the first direction and a fourth signal 748 in the second direction. In particular, the circular polarization signal 74 includes a left-hand circular polarization (LHCP) 742 and a right-hand circular polarization (RHCP) 744. The polarizer 705 transforms the left hand circular polarization 742 and the right hand circular polarization 744 into the third signal 746 and the fourth signal 748 respectively.

The filter 707 filters out an undesired high frequency noise from the first linear polarization signal 72 in the first waveguide 73. The first signal 722 and the second signal 724 with lower frequencies are preserved. In the embodiment, the present invention assumes that the frequency of the first linear polarization signal is lower than that of the circular polarization signal. On the other hand, if the frequency of the circular polarization signal is lower than that of the first linear polarization signal, the circular polarization signal will be filtered by a low pass filter. Accordingly, the present invention is not restricted to any limitation to the frequencies of the linear polarization signal and the circular polarization signal.

The first signal 726 and the second signal 728 of the first linear polarization signal 72 and the third signal 746 and the fourth signal 748 of the second linear polarization signal 74 are transferred respectively to the low noise block 711 and 709 for further integration. Thus, the signal with the linear polarization signal and the circular polarization signal is completely received and becomes a new signal with only one polarization-type.

Figure 8:
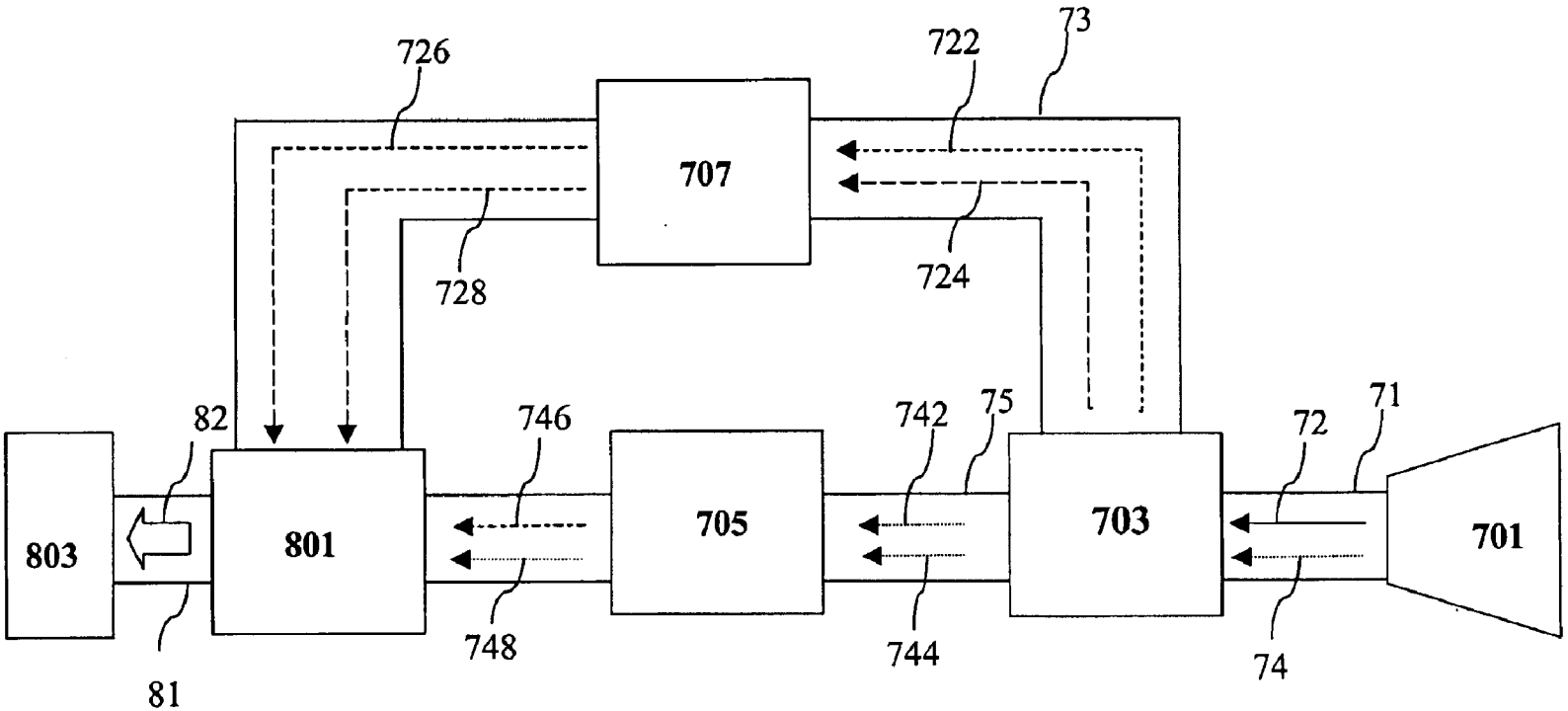
FIG. 8 is a schematic diagram of a second exemplary embodiment of an apparatus for receiving signals according to the present invention.

As shown in the FIG. 8, the present invention provides an apparatus for simultaneously receiving a signal having a first linear polarization signal 72 and a circular polarization signal 74. The first linear polarization signal 72 includes a first signal 722 in a first direction and a second signal 724 in a second direction. The first direction and the second direction are orthogonal to each other.

The apparatus includes a receiver 701, an ortho-mode transducer (OMT) 703, a polarizer 705, a filter 707, an ortho-mode integrator 801, and a low noise block 803.

As set forth in the first embodiment, the cross-section dimensions of the waveguides 73 and 75 are different so as to separate the first linear polarization signal 72 and the circular polarization signal 74 with different frequencies. After passing through the polarizer 705 and the filter 707, the present invention obtains the first signal 722, the second signal 724 of the first linear polarization signal 72 and the third signal 742, the fourth signal 744 of the second linear polarization signal 74.

The difference between the above two embodiments is that the present invention uses an ortho-mode integrator 801 to integrate the above four signals to obtain a integration signal 82 which is transferred to a waveguide 81. The integration signal 82 is transferred to the low noise block 803.

In the embodiment, the present invention reduces the required space and cost not only for building more antenna disks for receiving all types of signals, but also for a set of low noise block (LNB). Thus, the present invention becomes much simpler and inexpensive.

Figure 9:
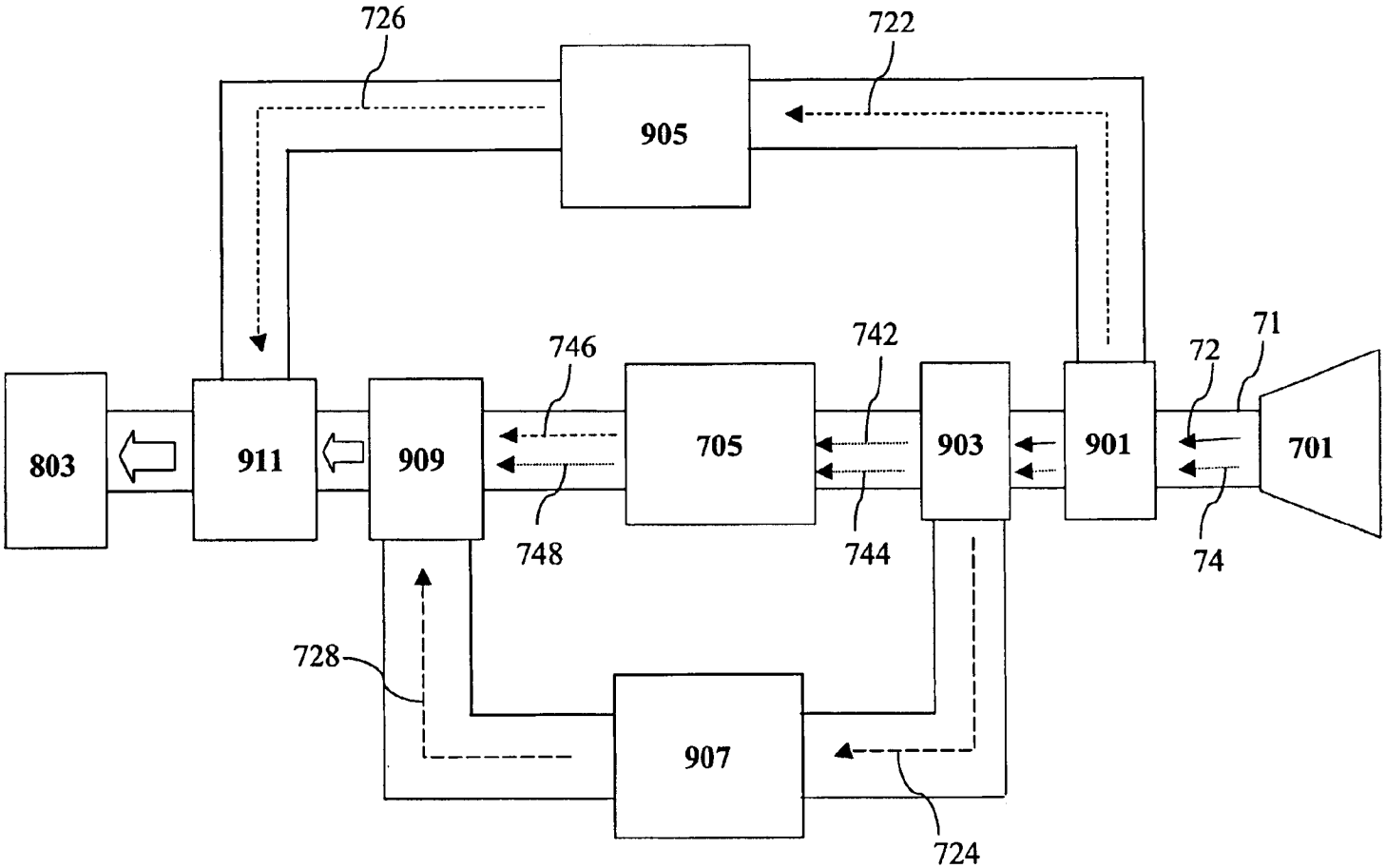
FIG. 9 is a schematic diagram of a third exemplary embodiment of an apparatus for receiving signals according to the present invention.

As shown in FIG. 9, the apparatus for receiving a signal includes a receiver 701, two ortho-mode transducers (OMT) 901 and 903, a polarizer 705, two filters 905 and 907, two ortho-mode integrators 909 and 911, and a low noise block 803.

Person skilled in the art could understand that the difference between the above two embodiments is that the first signal 722 and the second signal 724 of the first linear polarization signal 72 are separated respectively via the waveguide 71 and are integrated respectively with the circular polarization signal 74. Therefore, the present invention reduces the required space and cost not only for building more antenna disks for receiving all types of signals, but also for a set of low noise block (LNB). Thus, the present invention becomes much simpler and inexpensive. Furthermore, since the present invention separates the first signal and the second signal before low pass filtering them, a high performance filter, which is much more expensive, is not necessary.

The above description shows the apparatus and method for receiving signals having linear polarization signals and circular polarization signals.

Furthermore, the above embodiments assume the following two conditions: first, the frequency of the linear polarization signal is lower than that of the circular polarization signal; second, the received signal includes four signals, including the linear polarization signal having two orthogonal signals and the circular polarization signal having a left-hand circular polarization (LHCP) and a right-hand circular polarization (RHCP). However, the present invention could also implement in conditions, such as the frequency of the linear polarization signal is not lower than that of the circular polarization signal, receiving a signal including any one, two, or three of the above four signals. For example, the method and apparatus could be used to receive a signal with a left-hand circular polarization with lower frequency and a linear polarization signal in a vertical direction with higher frequency simultaneously.

Besides, as to oblique polarization signals, the present invention could also receive the oblique polarization signals by adjusting the angle of the receiving apparatus or by collocating with other devices, which are able to rotate the polarization angle. Consequently, the present invention is able to receive many types of signals, with whatever frequencies and polarization types.

In the foregoing specification the invention has been described with reference to specific embodiments. It will, however, be evident that various modification and changes may be made to thereto without departing from the broader spirit and scope of the invention. The specification and drawings are, accordingly, to be regarded in an illustrative rather than restrictive sense. Thus, it is intended that the present invention covers the modification and variations of this invention provided they come within the scope of the appended claims and their equivalents.

What is claimed is:

1. A method for receiving a signal, said method comprising the steps of:

(1) separating said signal into a first linear polarization signal and a circular polarization signal in a predetermined way;

(2) transforming said circular polarization signal into a second linear polarization signal; and (3) transferring said first linear polarization signal and said second linear polarization signal to an electric circuit.

2. The method according to claim 1, wherein said first linear polarization signal and said circular polarization signal have respectively different frequencies, said step (1) further comprises:

separating said first linear polarization signal and said circular polarization signal by using a plurality of waveguides, each of said waveguides has a different cutoff frequency.

3. The method according to claim 2, wherein said step (1) further comprises:

adjusting a cross-section dimension of each of said waveguides to vary value of said cutoff frequency.

4. The method according to claim 1, wherein the step (1) further comprises:

filtering out an undesired high frequency noise from one of said first linear polarization signal and said circular polarization signal that has a lower frequency.

5. The method according to claim 1, wherein between the step (2) and the step (3), said method further comprises the step of:

(4) integrating said first linear polarization signal and said second linear polarization signal together.

6. The method according to claim 1, wherein said first linear polarization signal selectively comprises a first signal and a second signal, said first signal is in a first direction and said second signal is in a second direction.

7. The method according to claim 6, wherein said first direction and said second direction are orthogonal to each other.

8. The method according to claim 6, wherein said first signal, said second signal, and said circular polarization signal respectively have different frequencies, said step (1) further comprises:

separating said first signal, said second signal, and said circular polarization signal by using a plurality of waveguides, each of said waveguides has a different cutoff frequency.

9. The method according to claim 8, wherein said step (1) further comprises:

adjusting a cross-section dimension of each of said waveguides to vary value of said cutoff frequency.

10. The method according to claim 6, wherein said second linear polarization signal selectively includes a third signal and a fourth signal, said third signal is in said first direction and said fourth signal is in said second direction, said circular polarization signal selectively includes a left-hand circular polarization (LHCP) and a right-hand circular polarization (RHCP), the step (2) further comprises the step of:

transforming said left-hand circular polarization and said right-hand circular polarization into said third signal and said fourth signal respectively.

11. The method according to claim 10, wherein between the step (2) and the step (3), said method further comprises the step of:

(5) integrating said first signal, said second signal, said third signal, and said fourth signal together.

12. A method for receiving a signal, said method comprising the steps of:

(1) separating said signal into a first separation signal and a second separation signal, said first separation signal selectively includes a first signal, said first signal is in a first direction and is a linear polarization signal;

(2) separating said second separation signal into a third separation signal and a fourth separation signal, said third separation signal selectively includes a second signal, said second signal is in a second direction and is a linear polarization signal, said fourth separation signal includes a circular polarization signal;

(3) transforming said circular polarization signal into a first linear polarization signal, said first linear polarization signal selectively includes a third signal in said first direction and a fourth signal in said second direction;

(4) integrating said second signal, said third signal, and said fourth signal together for obtaining a first integration signal;

(5) integrating said first signal and said first integration signal together for obtaining a second integration signal; and (6) transferring said second integration signal to a low noise block (LNB).

13. An apparatus for receiving a signal, said apparatus comprising:

a receiver for receiving said signal;

an ortho-mode transducer (OMT) for separating said signal into a first linear polarization signal and a circular polarization signal;

a polarizer for transforming said circular polarization signal into a second linear polarization signal; and an electric circuit for integrating said first linear polarization signal and said second linear polarization signal.

14. The apparatus according to claim 13, wherein said apparatus further comprises:

a plurality of waveguides, said ortho-mode transducer (OMT) separates said signal into said first linear polarization signal and said circular polarization signal respectively via said waveguides, each of said waveguides has a different cutoff frequency, value of said cutoff frequency is varied by adjusting a cross-section dimension of each of said waveguides.

15. The apparatus according to claim 13, wherein said apparatus further comprises:

at least a filter for filtering out an undesired high frequency noise from one of said first linear polarization signal and said circular polarization signal that has a lower frequency.

16. The apparatus according to claim 13, wherein said apparatus further comprises:

at least an ortho-mode integrator for integrating said first linear polarization signal and said second linear polarization signal.

17. The apparatus according to claim 14, wherein said first linear polarization signal selectively includes a first signal in a first direction and a second signal in a second direction, said ortho-mode transducer (OMT) further separates said signal into said first signal, said second signal, and said circular polarization signal respectively via said waveguides.

18. The apparatus according to claim 17, wherein said second linear polarization signal selectively includes a third signal in said first direction and a fourth signal in said second direction, said circular polarization signal selectively includes a left-hand circular polarization (LHCP) and a right-hand circular polarization (RHCP), said polarizer further transforms said left-hand circular polarization and said right-hand circular polarization into said third signal and said fourth signal respectively.

19. The apparatus according to claim 18, wherein said ortho-mode integrator further integrates said first signal, said second signal, said third signal, and said fourth signal together.

20. The apparatus according to claim 13, wherein said electric circuit further comprises at least a low noise block (LNB).

* * * * *